US008340967B2

(12) United States Patent
Silbert et al.

(10) Patent No.: US 8,340,967 B2
(45) Date of Patent: Dec. 25, 2012

(54) SPEECH SAMPLES LIBRARY FOR TEXT-TO-SPEECH AND METHODS AND APPARATUS FOR GENERATING AND USING SAME

(75) Inventors: Gershon Silbert, Tel-Aviv (IL); Andres Hakim, Kfar-Saba (IL)

(73) Assignee: VivoText, Ltd., Ramat Gan (IL)

( * ) Notice: Subject to any disclaimer, the term of this patent is extended or adjusted under 35 U.S.C. 154(b) by 426 days.

(21) Appl. No.: 12/532,170

(22) PCT Filed: Mar. 19, 2008

(86) PCT No.: PCT/IL2008/000385

§ 371 (c)(1),
(2), (4) Date: Sep. 21, 2009

(87) PCT Pub. No.: WO2008/114258

PCT Pub. Date: Sep. 25, 2008

(65) Prior Publication Data

US 2010/0131267 A1 May 27, 2010

Related U.S. Application Data

(60) Provisional application No. 60/907,120, filed on Mar. 21, 2007.

(51) Int. Cl.
*G10L 13/00* (2006.01)

(52) U.S. Cl. ..... 704/267; 704/258; 704/260

(58) Field of Classification Search ..... 704/258–269
See application file for complete search history.

(56) References Cited

U.S. PATENT DOCUMENTS 5,675,709 A * 10/1997 Chiba ..... 704/278
5,895,449 A * 4/1999 Nakajima et al. ..... 704/278
6,505,158 B1 * 1/2003 Conkie ..... 704/260
6,873,955 B1 * 3/2005 Suzuki et al. ..... 704/503
7,013,278 B1 * 3/2006 Conkie ..... 704/260
7,603,278 B2 * 10/2009 Fukada et al. ..... 704/260
2003/0009336 A1 * 1/2003 Kenmochi et al. ..... 704/258

(Continued)

FOREIGN PATENT DOCUMENTS

WO WO 2008/114258 9/2008

OTHER PUBLICATIONS

International Preliminary Report on Patentability Dated Oct. 1, 2009 From the International Bureau of WIPO Re.: Application No. PCT/IL2008/000385.

(Continued)

*Primary Examiner* — Douglas Godbold

(74) *Attorney, Agent, or Firm* — Myers Wolin, LLC

(57) ABSTRACT

A method of recording speech for use in a speech samples library. In an exemplary embodiment, the method comprises recording a speaker pronouncing a phoneme with musical parameters characterizing pronunciation of another phoneme by the same or another speaker. For example, in one embodiment the method comprises: providing a recording of a first speaker pronouncing a first phoneme in a phonemic context. The pronunciation is characterized by some musical parameters. A second reader, who may be the same as the first reader, is then recorded pronouncing a second phoneme (different from the first phoneme) with the musical parameters that characterizes pronunciation of the first phoneme by the first speaker. The recordings made by the second reader are used for compiling a speech samples library.

21 Claims, 3 Drawing Sheets

U.S. PATENT DOCUMENTS

| | | | | |
|---|---|---|---|---|
| 2004/0030555 | A1* | 2/2004 | van Santen | 704/260 |
| 2004/0111266 | A1* | 6/2004 | Coorman et al. | 704/260 |
| 2004/0111271 | A1 | 6/2004 | Tischer | |
| 2006/0069566 | A1* | 3/2006 | Fukada et al. | 704/260 |
| 2006/0155544 | A1* | 7/2006 | Chu et al. | 704/267 |
| 2006/0259303 | A1* | 11/2006 | Bakis | 704/268 |
| 2007/0168193 | A1* | 7/2007 | Aaron et al. | 704/260 |
| 2007/0203704 | A1* | 8/2007 | Ozkaragoz et al. | 704/260 |

OTHER PUBLICATIONS

International Search Report and the Written Opinion Dated Jul. 4, 2008 From the International Searching Authority Re.: Application No. PCT/IL2008/000385.

Eide et al. "A Corpus-Based Approach to <AHEM/> Expressive Speech Synthesis", 5th ISCA Speech Synthesis Workshop, Pittburgh, USA, XP002484987, p. 79-84, Jun. 14, 2004. Abstract, p. 80, r-h Col., § 1, 2, p. 81, § [3. Expressive Prosody Models].

Hamza et al. "The IBM Expressive Speech Synthesis System", Interspeech 2004—ICSLP, 8th Conference on Spoken Language Processing, Jeju Island, KR, XP002484988, p. 2577-2580, Oct. 8, 2004. Abstract, p. 2577, § [1. Introduction], p. 2577-2578, § [3.1 Building the Voice Database], Fig.1.

* cited by examiner

SPEECH SAMPLES LIBRARY FOR TEXT-TO-SPEECH AND METHODS AND APPARATUS FOR GENERATING AND USING SAME

RELATED APPLICATIONS

This application is a National Phase Application of PCT Patent Application No. PCT/IL2008/000385 having International Filing Date of Mar. 19, 2008, which claims priority from U.S. Provisional Patent Application No. 60/907,120, filed on Mar. 21, 2007. The contents of the above Application are all incorporated herein by reference.

FIELD OF THE INVENTION

The invention relates to speech samples libraries for synthesizing speech and to methods and apparatus of generating and using such libraries.

BACKGROUND OF THE INVENTION

Text-To-Speech technology allows computerized systems to communicate with users through synthesized speech. The quality of these systems is typically measured by how natural or human-like the synthesized speech sounds.

Very natural sounding speech can be produced by simply replaying a recording of an entire sentence or paragraph of speech. However, the complexity of human communication through languages and the limitations of computer storage may make it impossible to store every conceivable sentence that may occur in a text. Because of this, the art has adopted a concatenative approach to speech synthesis that can be used to generate speech from any text. This concatenative approach combines stored speech samples representing small speech units such as phonemes, diphones, triphones, or syllables to form a larger speech signal.

One problem with such concatenative systems is that a stored speech sample has a pitch and duration that is set by the context in which the sample was spoken. For example, in the sentence "Joe went to the store" the speech units associated with the word "store" have a lower pitch than in the question "Joe went to the store?" Because of this, if stored samples are simply retrieved without reference to their pitch or duration, some of the samples will have the wrong pitch and/or duration for the sentence resulting in unnatural sounding speech.

One technique for overcoming this is to identify the proper pitch and duration for each sample. Based on this prosody information, a particular sample may be selected and/or modified to match the target pitch and duration.

Identifying the proper pitch and duration is known as prosody prediction. Typically, it involves generating a model that describes the most likely pitch and duration for each speech unit given some text. The result of this prediction is a set of numerical targets for the pitch and duration of each speech segment. An example for a prosody predictor may be found at www.bach.arts.kuleuven.be/pmertens/prosody/mingus.html and references cited therein.

These targets can then be used to select and/or modify a stored speech segment. For example, the targets can be used to first select the speech segment that has the closest pitch and duration to the target pitch and duration. This segment can then be used directly or can be further modified to better match the target values.

For example, one technique for modifying the prosody of speech segments is the so-called Time-Domain Pitch-Synchronous Overlap-and-Add (TD-PSOLA) technique, which is described in "Pitch-Synchronous Waveform Processing Techniques for Text-To-Speech Synthesis using Diphones", E. Moulines and F. Charpentier, Speech Communication, vol. 9, no. 5, pp. 453-467, 1990, the contents of which is incorporated herein by reference.

Unfortunately, existing techniques for modifying the prosody of a speech unit have not produced completely satisfactory results. In particular, these modification techniques tend to produce mechanical or "buzzy" sounding speech, especially, when the difference between the required prosody and the recorded one is large.

Thus, it would be desirable to be able to select a stored unit that provides good prosody without modification or only with minimal modification.

However, because of memory limitations, samples cannot be stored for all of the possible prosodic contexts in which a speech unit may be used. Instead, a limited set of samples must be selected for storage. Because of this, the performance of a system that uses stored samples with limited prosody modification is dependent on what samples are stored.

US patent application publication No. 2004/0148171, assigned to Microsoft, suggests dealing with this problem by recording a very large corpus, for instance, a corpus containing about 97 million Chinese Characters, and selecting from this corpus a limited set of sentences, identified to include the most necessary 'context vectors'. Only speech samples from the selected units are stored.

U.S. Pat. No. 6,829,581 discloses synthesizing speech by a synthesizer based on prosody prediction rules, and then asking a reader to imitate the synthesized speech. The reader is asked to preserve the nuance of the utterance as spoken by the synthesizer and to follow the location of the peaks and dips in the intonation while trying to still sound natural. The speaker sees the text of the sentence, hears it synthesized two to three times, and records it. Speech segments taken from speech recorded in this way are concatentated to synthesize speech of other sentences. The method is described in the patent as circumventing the need to concatenate dissimilar speech units to each other.

U.S. Pat. No. 5,915,237 discloses a speech encoding system for encoding a digitized speech signal into a standard digital format, such as MIDI.

US Patent Application Publication No. 2006/0069567 describe TTS systems based on voice-files, comprising speech samples taken from words spoken by a particular speaker. In one example, the speaker reads the words from a pronunciation dictionary.

GLOSSARY

The following terms will be used throughout the description and claims and should be understood in accordance with the invention to mean as follows:

A speech segment—a sequence of phonemes comprising a central phoneme pronounced by a human in a specific phonemic context and with specific musical parameters. The number of preceding phonemes is not necessarily equal to the number of the following phonemes, so the central phoneme is not necessarily exactly in the center of a speech segment. In an exemplary embodiment of the invention, a speech segment has a central phoneme, one half-phoneme preceding it and one half-phoneme following it. Such speech segment is known in the art as a triphone.

A speech sample—a recording of a speech segment, associated with indicators that are indicative of the central phoneme, the phonemic context in which it was spoken, and the musical parameters characterizing the recorded pronunciation of the central phoneme.

Phonemic context is the speech segment absent the central phoneme. The phonemic context includes at least one half phoneme preceding the central phoneme and at least one half phoneme following the central phoneme.

Musical parameter of a central phoneme is defined by at least two variables characterizing the pronunciation of the central phoneme. Optionally, these parameters comprise two or more of a pitch curve, pitch perception, duration and volume.

Musical index—a discrete musical parameter indicator, indicative of a range, within which a musical parameter of a central phoneme is pronounced. In an exemplary embodiment of the invention, a speech sample has at least two musical indexes, and each musical index optionally has a limited number of discrete allowed values. This way, recordings having slightly different pitches, for instance, may all be indexed with pitch index of the same value, say, "high pitch". By this, the infinite variety of human expression may be quantized to a limited number of musical parameters.

If a phoneme pronounced in a specific value of a musical parameter within the range indicated by the index is required for generating speech from a given text, the phoneme may be provided by processing a recording of the same phoneme and the appropriate musical index with digital signal processing (DSP). Optionally, the indexed ranges are narrow enough such that DSP required for taking a recording from its original value to any other value within the indexed range does not result in noticeable degradation of the audio quality of the sound.

Musical vector—the 'tone' in which a phoneme, indexed with musical indexes of given values, is pronounced, regardless of the identity of the phoneme and its phonemic context. For instance, in an embodiment of the invention, all phonemes pronounced with high pitch perception, flat pitch curve, long duration, and low volume have the same musical vector, while phonemes pronounced with low pitch perception, flat pitch curve, long duration, and low volume have another musical vector. The musical vector may be denoted by a vector of the musical indexes.

SUMMARY OF THE INVENTION

An aspect of some embodiments of the invention relates to a method for obtaining a speech samples library.

In an exemplary embodiment of the invention, a human speaker is recorded while reading words, with each phoneme being pronounced with predefined musical parameters.

In an exemplary embodiment of the invention, the method includes controlling contexts at which phonemes are naturally pronounced. This may be done, for instance, by providing a reader with texts designed to include phonemes in predefined contexts.

Optionally, the speaker is first recorded reading a text in a natural manner, to produce recordings of at least one phoneme pronounced with each value of each musical index. Then, the reader is instructed to pronounce other words with the same intonation he read words from the text. This way, the speaker reads with natural intonation more and more phonemes with the same musical vectors. The other words the speaker is instructed to read are not necessarily meaningful. They may have a meaning, but are chosen mainly in accordance with the speech segments they represent. In an exemplary embodiment of the invention the other words are pronounced out of any context, such that the musical parameters are not affected by a context in which a word is read.

In an exemplary embodiment of the invention the other words are read in a context designed to call for reading at least one of the phonemes in the words with specific musical parameters.

Each recorded word is digitally processed into a plurality of speech samples by processing the recorded word into phonemes, each at its phonemic context, and associating the recording with indicators indicating the phoneme, its phonemic context and musical parameters. As the musical parameters of each phoneme were pre-defined, there is no analysis required for associating musical parameters to the recordings. Optionally, if a phoneme is recorded more than once in the same phonemic environment and with the same musical vector, all the recordings, except for one, are discarded.

An aspect of some embodiments of the invention relates to a speech samples library obtainable as described above. In an exemplary embodiment of the invention, the speech samples library comprises speech samples, arranged such that the samples are retrievable in accordance with the phonemic context indicators and the musical parameter indicators of the speech samples. Optionally, the library is in the form of an array of pointers, each pointing to a speech segment recording, and the position in the array is responsive to the values of the musical indexes and phonemic context indicators.

Optionally, the speech samples library is complete, in the sense that it allows synthesizing speech of high naturalness out of any text of a given language, without using distortive DSP. In an embodiment of the invention, DSP is considered distortive if it degrades the voice quality. Examples of distortive DSP include pitch manipulations that cause unnatural formant transitions, volume manipulations that result is sudden volume drops or peeks and/or duration manipulations that result in audible glitches such as buzz, echo or clicks.

In an exemplary embodiment of the invention, text is translated into speech with a speech samples library according to the invention, as follows. First, the phonemes and their phonemic contexts are retrieved from the text with grapheme to phoneme application, and the musical parameters characterizing each phoneme are determined based on a prosody predicting method. Methods of both phoneme to grapheme conversion and prosody prediction are known in the art and available to a skilled person. The result of the prosody prediction is a set of numerical targets for the musical parameters of each phoneme. Speech segments having the central phonemes and phonemic contexts as required, and musical parameters similar to those targeted by the prosody predictor are found in the library, and concatenated to produce the speech. Optionally, before concatenating, one or more of the samples goes digital signal processing to adjust its musical parameters to the target value and/or to smooth concatenation with another speech sample. Preferably, this DSP is small enough not to distort the voice quality of the speech segment.

Thus, in accordance with an embodiment of the present invention, there is provided a method of recording speech for use in a speech samples library, the method comprising recording a speaker pronouncing a phoneme or a sequence of phonemes with musical parameters characterizing pronunciation of non identical phoneme or sequence of phonemes, thereby recording speech for use in the speech samples library.

Optionally, the method comprising:

(a1) providing a recording of a first speaker pronouncing a sequence of phonemes, each in a phonemic context, a pronunciation of each of said phonemes being characterized by at least one musical parameter; and (b1) recording a second speaker pronouncing a first phoneme in a phonemic context, the first phoneme pronounced with the at least one musical parameter characterizing a pronunciation of a second phoneme by the first speaker, wherein said second phoneme is different from said first phoneme and/or the phonemic context of said second phoneme is different from the phonemic context of said first phoneme.

Optionally, the first speaker and the second speaker are the same.

Optionally, pronouncing a first phoneme in a phonemic context comprises pronouncing a sequence of phonemes, said sequence comprising the first phoneme.

There is also provided according to an embodiment of the invention a method of generating a speech samples library comprising:

(a2) recording speech using a method according to claim 1;

(b2) dissecting recordings of words made in (a2) into recordings of speech segments, each having a central phoneme;

(c2) associating each speech segment recording with at least one indicator indicative of a musical parameter of the central phoneme; and (d2) arranging the speech samples recordings to be each retrievable in accordance with the at least one indicator associated therewith.

Optionally, one or more of said sequence of phonemes is meaningless.

Optionally, a method according to an embodiment of the invention comprises:

(a3) recording a speaker naturally reading a text, the text comprising a first collection of words in context;

(b3) providing a second collection of words;

(c3) recording a speaker pronouncing words of the second collection with musical parameters, with which words of the first collection were read in (a3).

Optionally, the second collection has more words than the first collection.

Optionally, associating a speech segment recording with an indicator indicative of a musical parameter of the central phoneme comprises:

(a4) defining a physical range of a musical parameter to be of a certain level;

(b4) analyzing the musical parameter defined in (a1) to be of the certain level; and (c4) associating the speech segment recording with an index indicative of said certain level.

Optionally, defining a physical range of a musical parameter to be of a certain level comprises analyzing the recording of text that was read in context at (a3) to determine ranges of physical parameters, which are of a certain level in said recording.

Optionally, the at least one musical parameter comprises one or more of pitch perception and pitch curve.

Optionally, musical parameters comprise duration.

Optionally, musical parameters comprise volume.

There is further provided by an embodiment of the present invention a speech samples library comprising a plurality of recordings, each of a central phoneme pronounced with at least one musical parameter and in a phonemic context, and being retrievable from the library in accordance with the central phoneme, the phonemic context, and the at least one musical parameter.

Optionally, the at least one musical parameter comprises pitch perception.

Optionally, the at least one musical parameter comprises pitch curve.

Optionally, the at least one musical parameter comprises duration.

Optionally, at least one index indicative of the at least one musical parameter is associated with each recording, and said index has a value selected from 5 or less possible values.

Optionally, each of said values corresponds to a range of physical values of the musical parameter, and the musical parameter of the central phoneme in the recording is within said range.

Optionally, a speech samples library according to an embodiment of the invention is generated in a method according to the invention.

There is also provided in accordance with some embodiments of the present invention an apparatus for producing speech from text, comprising:

(a) an input for inputting the text;

(b) a parser, for translating the text into a sequence of speech segments, each having a central phoneme;

(c) a prosody predictor, for associating with each central phoneme in said speech segments musical parameters predicted to it by said prosody predictor based on the text;

(d) a speech samples library, (e) a concatenator for concatenating speech segments copied from the library and (f) an output unit, for playing the concatenated speech, wherein the speech samples library is according to an embodiment of the invention.

Optionally, the apparatus comprises a DSP unit for adjusting musical parameters of speech segments copied from the speech samples library to target musical parameters defined by the prosody predictor.

Optionally, the speech segments copied from the speech samples library are characterized with musical parameters close enough to the musical parameters associated with the central phoneme of the speech segment by the prosody predictor, such that the DSP unit is capable of adjusting all musical parameters of the speech segment to target musical parameters defined by the prosody predictor without causing degradation of voice quality.

BRIEF DESCRIPTION OF THE DRAWINGS

Some embodiments of the invention are herein described, by way of example only, with reference to the accompanying drawings. With specific reference now to the drawings in detail, it is stressed that the particulars shown are by way of example and for purposes of illustrative discussion of embodiments of the invention. In this regard, the description taken with the drawings makes apparent to those skilled in the art how embodiments of the invention may be practiced. Also, in reading the present description and claims it should be noted that the terms "comprises", "comprising", "includes", "including", "having" and their conjugates mean "including but not limited to".

In the drawings.

DETAILED DESCRIPTION OF SPECIFIC EMBODIMENTS

Figure 1:
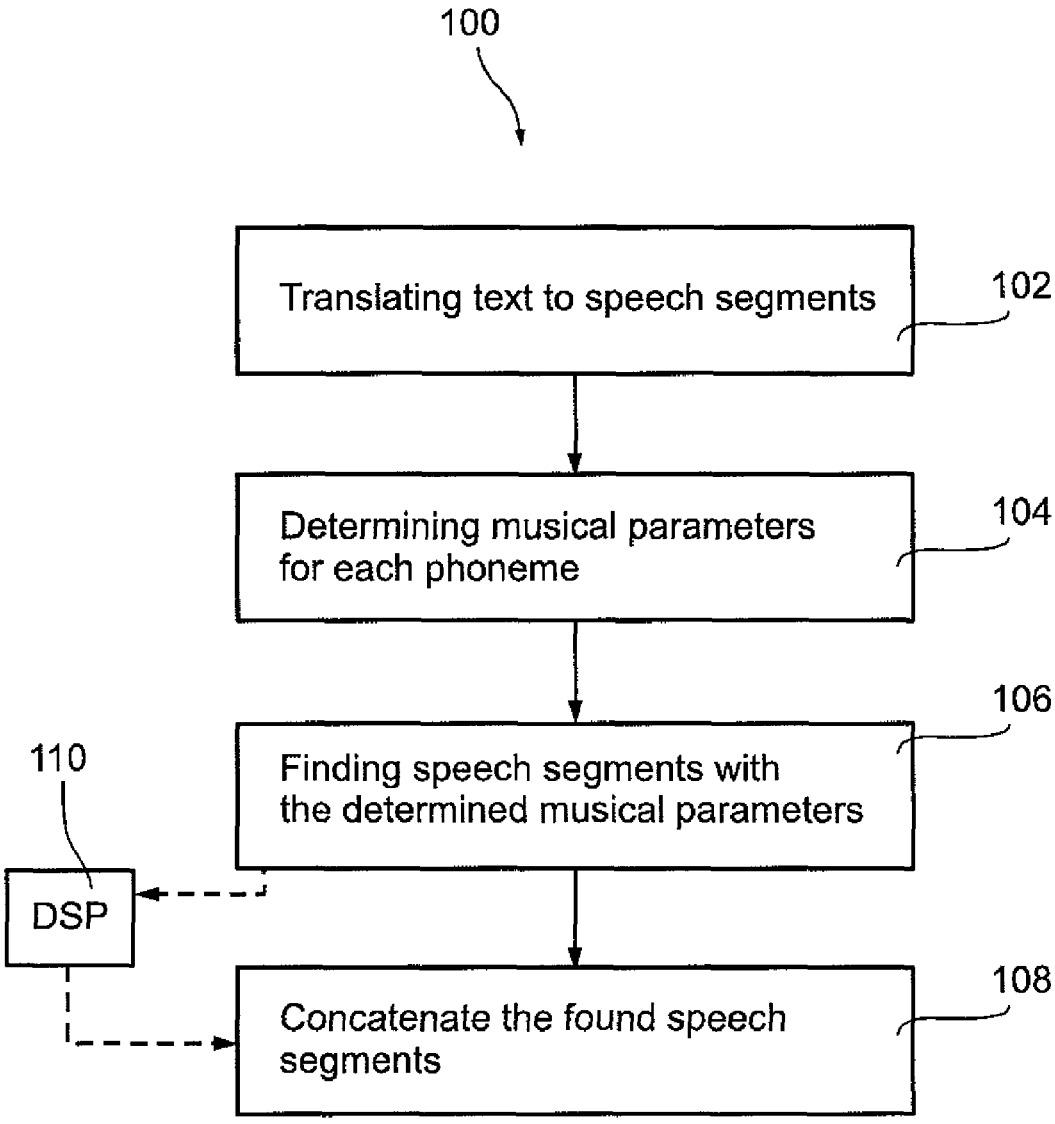
FIG. 1 is a flowchart of actions taken in a method of translating text into speech with a speech samples library according to an embodiment of the invention.

Before explaining at least one embodiment of the invention in detail, it is to be understood that the invention is not necessarily limited in its application to the details of construction, the arrangement of the components, or the methods described in the following description, drawings or Examples. The invention is capable of other embodiments or of being practiced or carried out in various ways.

Phonemic Context

There are about 40 phonemes in the English language, so each phoneme can have at least 1600 different phonemic contexts, which amounts to 64,000 different speech segments. However, not all the phonemic contexts are useful in the English language. For instance, the triphones BPB, KBN, JJJ, and many others, are not useful in English. In an embodiment of the invention, speech segments that are not useful do not form part of the library. Usefulness of speech segments may be evaluated from known statistics on frequency of appearance of words and phrases in English texts. However, as less speech segments are treated as useless, the resultant library is closer to being complete.

In an embodiment of the invention, only triphones including at least one vowel are treated as useful. As out of the 40 phonemes 26 are consonants this results in about 35% less triphones than if all triphones are considered useful.

Musical Indexes

In an embodiment of the invention there are two primary musical indexes: pitch curve index and duration index. Volume index may optionally be used.

Optionally, the pitch curve index has three values: flat, ascending, and descending.

Optionally, the duration has two values: short and long.

Optionally, musical indexes of different phonemes may have a different number of values. For instance, the duration index of the phoneme T may have only one value, and the duration index of the phoneme O may have three values, and the duration index of the phoneme F, may have two values. Similarly, the number of values that a pitch curve index may have is optionally different for different phonemes.

In an embodiment of the invention, there is also an index for pitch perception, which is the general pitch impression a pronunciation leaves on a listener. The pitch perception index optionally has four values: beginning of phoneme (for cases where the beginning of the phoneme leaves the strongest impression) end of phoneme, middle of phoneme and bifurcated phoneme (where there are two pitches, each having a similar impact on the listener.

In an embodiment of the invention, there is also an index for volume. Optionally, the volume index is expressed as 'volume' and may have two values: low and high.

The number of allowed combinations of musical index values may vary between embodiments. However, for reading a text in the English language with 95% of naturalness or higher, assuming that DSP does not change pitch or duration in more than 20% each, six combinations may be sufficient: three pitch curves and two durations.

In an exemplary embodiment of the invention, there are at least 36 index combinations for each vowel (3 pitch-perception values, 3 pitch curve values, 2 duration values and 2 volume values), 8 for each voiced consonant, such as 'l', 'm', 'n' (2 pitch-perception values, 2 duration values and 2 volume values) and 2 for unvoiced consonants, such as 'p' and 't' (2 duration values).

Training a Speaker

In an embodiment of the invention, a first stage in preparing a speech samples library is recording a speaker reading a text in a way that is natural to the speaker.

In an embodiment of the invention, the definitions of long, short, and medium, as well as the definitions of all other musical index values are speaker-dependent. Optionally, a short text is read by the speaker for defining physical values for each index. For instance, a long F may be 100 ms, a medium-length F may be 70 ms, and a short F may be 40 ms. A recording of the short text is analyzed to define physical values for each of the musical index values.

Optionally, the decision on how many values each index may have depends on the results of the analysis. For instance, if a speaker uses naturally a wide register of pitches, his speech samples library may include more pitch index values than a speech samples library of another speaker that uses a more limited register of pitches.

When each index value is associated with a physical value, the recording of the short text read by the speaker (or a recording of another short text read by the same speaker) is analyzed for musical indexes to ensure that each musical index combination appears in the text at least once. If not, additional texts may be read and recorded.

Recording Voice Segments

Once each musical index combination is naturally read at least once by the speaker, the speaker is instructed to read words having the same musical structure as words in the text, but different phonemes. These words may have meaning, but may also be meaningless. Before reading the new word, the speaker optionally hears the corresponding word read by him as part of reading the short text, and instructed to read the new word with exactly the same intonation. This way, the reader imitates himself, and produces recordings of more and more phonemes having the recorded musical parameters.

Size of Libraries

In an exemplary embodiment of the invention, each musical index has 5 possible values or less, for instance, 4, 3, or 2 values. Some indexes may have only one value, and these indexes are disregarded in the preparation or use of the speech samples library. At least two musical indexes have more than one possible value. Optionally, the number of possible values of one or more of the musical indexes is dependent on the phoneme. For instance, in an exemplary embodiment of the invention, the number of values that the pitch index can have for central phoneme F is smaller than the number of values the same index may have for the phoneme A.

In an overly comprehensive set of recordings, triphones with a vowel as a central phoneme are recorded 36 times each, triphones with a voiced consonant central phoneme are recorded 8 times each and triphones with an unvoiced consonant central phoneme are recorded 2 times. This results in 40 preceding phonemes*(16*36+4*8+20*2)*40 following phonemes=1,036,800 samples.

Omitting unnecessary triphones and musical combinations considerably reduces this number.

In an exemplary embodiment of the invention, a speech samples library comprises as little as 50,000 samples. In other embodiments, libraries have 100,000, or 200,000, 300,000, or any smaller or intermediate number of samples.

It should be noted that the length of each speech sample is between about 10 milliseconds and about 200 milliseconds, and therefore, the entire storage required for storing even 50,000 samples at a sample rate of 8,000 samples per second is only about 1 GB.

Exemplary Synthesize of Speech with a Speech Samples Library

FIG. 1 is a flowchart of actions taken in a method (100) of translating text into speech with a speech samples library according to an embodiment of the invention. In the beginning, the text is translated (102) to a sequence of triphones. Optionally, the triphones overlap. For instance, the word motorist may be translated to the sequence: silence-mo, mot, oto, tor, ori, ris, ist, st-silence. Then, the musical parameters of each phoneme are determined (104) using a prosody prediction method, many of which are known in the art. The result of the prosody prediction is a set of numerical targets for the musical parameters of each phoneme. Speech segments having the central phonemes, phonemic contexts, and musical indexes indicating ranges of musical parameters, within which the numerical targets lye, are found (106) in the library based on the musical indexes associated with the speech segments, and concatenated (108) to produce the speech. Optionally, before concatenating, one or more of the segments undergoes digital signal processing (110) to adjust its musical parameters to those required by the prosody prediction. Preferably, this DSP is small enough not to distort the voice quality of the speech segment.

Figure 2:
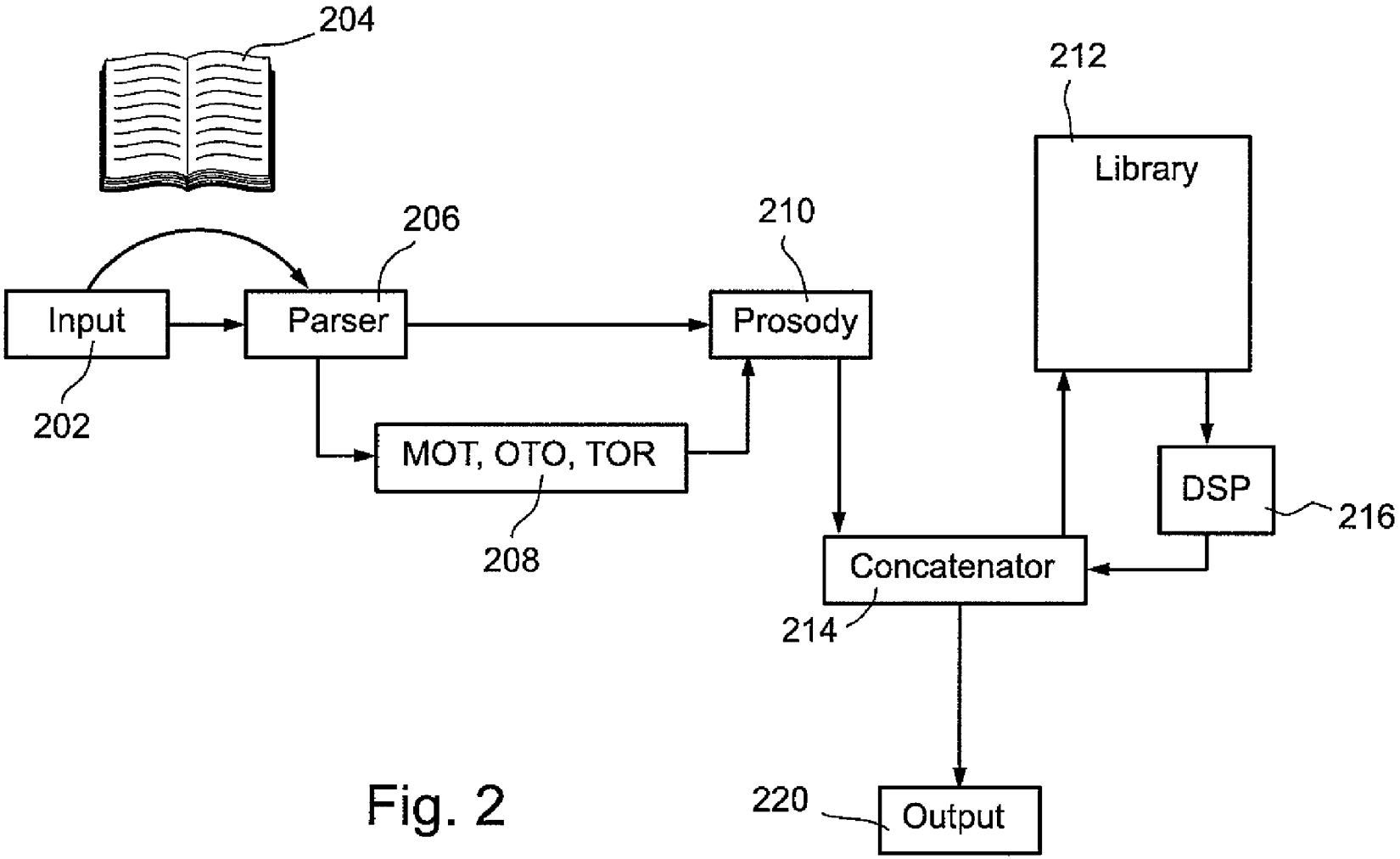
FIG. 2 is a block diagram of a TTS machine (200) operative to function with a speech samples library according to an embodiment of the invention.

FIG. 2 is a block diagram of a TTS machine (200) operative to function with a speech samples library according to an embodiment of the invention. Machine 200 comprises:

an input (202) for inputting the text to be spoken (204);

a parser 206, for translating text 204 into a sequence of triphones 208;

Prosody predictor (210), for associating with each central phoneme in triphones 208 musical parameters predicted to it by prosody predictor 210 based on text 204;

a speech samples library 212 according to an embodiment of the invention, configured to allow retrieval of speech segments by triphone identity and musical indexes of the central phonemes in each triphone;

a concatenator 214 for concatenating speech segments copied from the library according to a sequence determined by parser 206 and prosody detector 210; optionally a DSP unit (216) for adjusting musical parameters of the speech segments saved in the speech samples library to target musical parameters defined by prosody predictor 208; and an output unit (220), such as a loud speaker, for playing the concatenated speech.

Exemplary Method of Creating a Speech Samples Library

Figure 3:
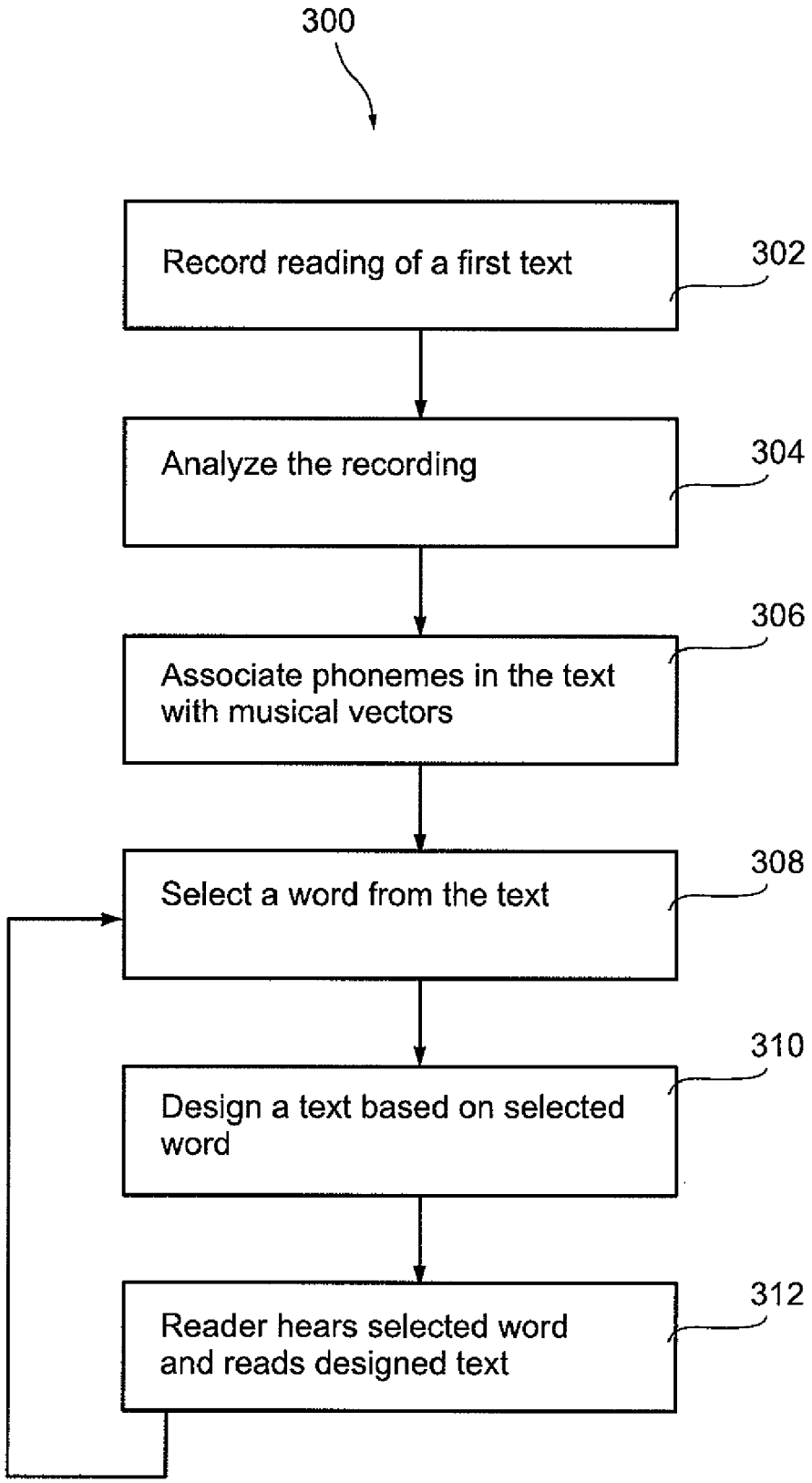
FIG. 3 is a flowchart showing actions to be taken in compiling a speech samples library according to an embodiment of the invention.

FIG. 3 is a flowchart showing actions to be taken in compiling a speech samples library according to an embodiment of the invention.

At 302, a speaker reads a text, and the reading is recorded. Optionally, the text is a series of independent sentences. Here, independent means that one sentence does not create a context that affects natural reading of a following (or preceding) sentence.

Optionally, the text includes pronunciation instructions. For instance, the sentence "I am a good girl" may appear with instructions what word to emphasize: I, am, good, or girl. Optionally, the sentence appears in the text 4 times, each with instructions to emphasis one of the words. (I am a good girl; I am a good girl; etc.)

At 304, the recording obtained at 302 is analyzed, and the physical ranges of musical parameters used by the reader are identified, and divided to sub ranges. Based on this division, a physical range is associated with each value of each musical index. For instance, if the reader read phonemes with pitch perception of between 100 Hz and 400 Hz, this range may be divided to sub-ranges of 100 to 200 Hz to be indexed as low pitch; 201 to 300 Hz to be indexed as intermediate pitch, and 301 to 400 Hz to be indexed as high pitch.

Optionally, the physical sub-ranges are determined such that modifying a recording of a phoneme from being at a middle of a sub-range to being at the edge of the sub-range, does not require distortive DSP.

To facilitate the analysis at 304, it is useful to provide at 302 a text that calls for using musical parameters with values that span broad physical ranges of musical parameters. For instance, a text that the reader reads using low, intermediate, and high pitch, short intermediate and long durations, etc.

In an exemplary embodiment of the invention, the text provided at 302 is designed such that the analysis at 304 results in defining a physical sub-range to each value of each musical index.

Optionally, the text is designed such that a recording of natural reading of the text results in obtaining at least one recording to be indexed with each value of each musical index. This may facilitate evaluating a physical range used by the reader for each musical parameter, when the reader reads a text in a natural manner. For instance, this may allow determining what pitch range is average pitch with the specific reader, what pitch range is low and what pitch range is high.

Optionally, more than one phoneme appears in the text with each musical index and value, to allow evaluating average pitch, duration, etc. of different phonemes independently of each other. For instance, what is the average duration of phoneme T, M, or O.

At 306, the recorded phonemes appearing in the written text are associated with musical vectors, namely, with indexes indicative of the range in which their musical parameters lie.

At 308, a word is selected from the recording made at 302 in accordance with the musical vectors it comprises.

At 310, a text is designed to enable the speaker to produce in a most natural manner at least one musical vector that appears in the word selected at 308, optionally with other phonemes and/or phonemic context.

Optionally, the text includes one or more meaningless words.

Additionally or alternatively, the text includes sentences, during natural reading of which, at least one phoneme is pronounced with musical vectors that appear in the word selected at 308.

At 312, the speaker hears the word or combination of words selected at 308, and reads the text designed at 310 with the same intonation. The recording at 312 is monitored for closeness of the recorded musical vectors to the desired musical vectors and is repeated if the deviation exceeds permissible boundaries.

Actions 308-312 are repeated until all the useful speech segments are recorded.

The word selected at 308 and the word produced at 310 may be each a single word or a string of words. In an exemplary embodiment of the invention, the words or word strings are selected at 308 to produce a context, in which at least one of the phonemes in the word or word string will be pronounced with a pre-defined musical vector. For instance, the recording made at 308 may include the sentence "I am a good girl" with emphasis on the word "good". In this recording, the vowel 'oo' appears in phonemic context defined by 'g' preceding it and 'd' following it, and musical vectors defined by a higher than mid-range pitch perception, a fairly straight pitch curve and long duration. To record, at 312, a similar speech segment, but with an 'f' instead of the 'g', one could instruct the speaker to read the sentence "this food is bad" with an emphasis on 'food' as close to the emphasis on 'good' in the recorded sentence "I am a good girl". This way, musical parameters will be reproduced naturally, and still in conformity with the musical parameters produced at 308.

In another embodiment of the invention, the reader may be instructed to read "food" (and not "this food is bad"), while imitating his/her own reading of the word "good" in the sentence "I am good". Optionally, the reader listens to the entire sentence "I am good", before reading the word "food".

Alternatively or additionally the speaker listens to a recording of the word "good", taken from the recording of the sentence "I am good".

Optionally, the reader records a whole series of words in the same musical vector, listening to the recording of the word "good" in the above-mentioned sentence. These may include, for instance mood, could, hood, goon, goom, etc.

The invention claimed is:

1. A method for generation of an expressive speech library, comprising:

recording a first speaker reading a text by a recording device including a non-transitory computer readable medium, wherein the recorded reading is saved in the non-transitory computer readable medium;

analyzing the recorded reading based on a set of predefined musical vectors by identifying at least one physical range of at least one musical parameter used by the first speaker when reading the text; dividing the at least one identified physical range into a plurality of sub ranges; and associating each sub range of the plurality of sub ranges with a different value of at least one of the musical vectors of the set of predefined musical vectors;

determining based on the analysis whether at least one segment of text corresponding to at least a portion of the recorded text is to be reread by the first speaker;

providing an indication to the first speaker to reread each of the at least one segment of the text;

recording the first speaker reading each of the at least one segment of text; and including in the expressive speech library at least a recording of the first speaker reading each of the at least one segment of text.

2. The method of claim 1, further comprising:

determining whether a rerecorded segment of the text is to be rerecorded.

3. The method of claim 1, wherein at least a portion of the set of predefined musical vectors is generated responsive of a prerecording of the text.

4. The method of claim 1, wherein the text is prerecorded by at least one of: the first speaker, and a second speaker.

5. The method of claim 1, wherein the at least one musical parameter is any one of: a pitch curve, a pitch perception, duration, and a volume.

6. The method of claim 5, wherein a value of a musical vector is an index indicative of a sub range in which its respective at least one musical parameter lies.

7. The method of claim 1, wherein determining based on the analysis whether the at least one segment of text is to be reread by the first speaker further comprising:

determining the usefulness of each of the at least one segment of text.

8. The method of claim 7, wherein the usefulness of the at least one segment of text is determined based, in part, on a number of vowels included in the at least one segment of text.

9. The method of claim 7, further comprising:

selecting at least one word from the at least portion of the recorded text based on at least one musical vector that appears in the word; and providing the at least one segment of text for the first speaker to record the at least one musical vector that appears in the at least one selected word.

10. The method of claim 9, wherein the at least one segment of text comprises at least any one of a word, a string of words, and a sentence with at least one of phonemes and phonemic context not contained in the selected at least one word.

11. A computer software product embedded in a non-transient computer readable medium containing instructions that when executed on the computer perform the method of claim 1.

12. A system for generation of an expressive speech library, comprising:

an input device for capturing a voice of a first speaker reading a text and at least one segment of text;

an analyzer for analyzing the recorded reading of the text based on a set of predefined musical vectors, wherein the analyzer is further configured to determine based on the analysis whether the at least one segment of text corresponding to at least a portion of the recorded text is to be reread by the first speaker, wherein the analyzer is further configured to identify at least one physical range of at least one musical parameter used by the first speaker when reading the text; divide the at least one identified physical range into a plurality of sub ranges; and associate each sub range of the plurality of sub ranges with a different value of at least one of the musical vectors of the set of predefined musical vectors; and an output device for notifying the first speaker to reread each of the at least one segment of text.

13. The system of claim 12, wherein the analyzer is further configured to determine whether a rerecorded segment of the text is to be rerecorded.

14. The system of claim 12, wherein at least a portion of the set of predefined musical vectors is generated responsive of a prerecording of the text.

15. The system of claim 12, wherein the text is prerecorded by at least one of: the first speaker, and a second speaker.

16. The system of claim 12, wherein the at least one musical parameter is any one of: a pitch curve, a pitch perception, duration, and a volume.

17. The system of claim 16, wherein a value of a musical vector is an index indicative of a sub range in which its respective at least one musical parameter lies.

18. The system of claim 12, wherein the analyzer is further configured to determine the usefulness of each of the at least one segment of text.

19. The system of claim 18, wherein the usefulness of the at least one segment of text is determined based, in part, on a number of vowels included in the at least one segment of text.

20. The system of claim 18, wherein the analyzer is further configured to:

select at least one word from the at least portion of the recorded text based on at least one musical vector that appears in the word; and provide the at least one segment of text for the first speaker to record the at least one musical vector that appears in the at least one selected word.

21. The system of claim 20, wherein the at least one segment of text comprises at least any one of a word, a string of words, and a sentence with at least one of phonemes and phonemic context not contained in the selected at least one word.

* * * * *